United States Patent [19]

Klemm

[11] 4,321,974

[45] Mar. 30, 1982

[54] ANNULAR DRILLING HAMMER

[75] Inventor: Gunter Klemm, Wenkhausen, Fed. Rep. of Germany

[73] Assignee: Hydroc Gesteinsbohrtechnik GmbH, Olpe, Fed. Rep. of Germany

[21] Appl. No.: 64,078

[22] Filed: Aug. 6, 1979

[30] Foreign Application Priority Data

Dec. 16, 1978 [DE] Fed. Rep. of Germany ..... 2854461

[51] Int. Cl.[3] ..... E21B 4/14; E21B 10/02

[52] U.S. Cl. ..... 175/92; 175/215; 175/405

[58] Field of Search ..... 175/405, 404, 330, 332, 175/333, 387, 215, 324, 92

[56] References Cited

U.S. PATENT DOCUMENTS

| | | | |
|---|---|---|---|
| 2,034,072 | 3/1936 | Wright | 175/387 |
| 2,053,801 | 9/1936 | Mitchell | 175/387 |
| 2,659,577 | 11/1953 | Watson | 175/405 X |
| 3,026,952 | 3/1962 | Am | 175/330 |
| 3,208,539 | 9/1965 | Henderson | 175/215 |
| 3,215,210 | 11/1965 | Dickinson | 175/405 |
| 3,280,925 | 10/1966 | Becker et al. | 175/405 |
| 3,524,511 | 8/1970 | Klemm | 175/405 X |
| 3,934,662 | 1/1976 | Cuvington et al. | 175/405 |
| 3,951,220 | 4/1976 | Phillips, Jr. et al. | 175/404 |
| 3,982,596 | 9/1976 | Vetter | 175/404 |
| 4,130,170 | 12/1978 | Holman | 175/464 X |
| 4,171,187 | 10/1979 | Reed | 175/215 |

FOREIGN PATENT DOCUMENTS

| | | | |
|---|---|---|---|
| 118802 | 3/1901 | Fed. Rep. of Germany | 175/387 |
| 266671 | 6/1971 | U.S.S.R. | 175/405 |

*Primary Examiner*—William F. Pate, III

*Attorney, Agent, or Firm*—Spensley, Horn, Jubas & Lubitz

[57] ABSTRACT

An annular drilling hammer having an annular bore crown guided between an outer tube and an inner tube. An annular hammer piston periodically strikes the bore crown and has a piston member that is guided in a cylindrical chamber having control apertures which are connected fluidically to a reversing valve. The working medium is delivered to the reversing valve between an inner tube system and an outer tube system. After driving the hammer piston the medium is discharged from the drill between the outer tube and the bore crown. The bore crown is provided with flow channels leading from the rear shoulder through and to the front and/or central aperture of the bore crown. The flow of driving medium through these channels aids the entrainment of bored material, which then is carried out through the inner tube with the aid of a Venturi opening.

5 Claims, 5 Drawing Figures

ANNULAR DRILLING HAMMER

BACKGROUND OF THE INVENTION

1. Field of the Invention

This invention relates to an annular drilling hammer having an annular bore crown guided between an outer tube and an inner tube. An annular hammer piston periodically strikes the bore crown and has a piston member that is guided in a cylindrical chamber having control apertures which are connected fluidically to a reversing valve. The working medium is delivered to the reversing valve between an inner tube system and an outer tube system. After driving the hammer piston the medium is discharged from the drill between the outer tube and the bore crown. The bore crown is provided with flow channels leading from the rear shoulder through and to the front and/or central aperture of the bore crown. The flow of driving medium through these channels aids the entrainment of bored material, which then is carried out through the inner tube system. Preferred bore crown configurations are shown for preventing core building.

2. Description of the Prior Art

Prior art annular drilling or coring devices (U.S. Pat. No. 3,524,511 and U.S. Pat. No. 3,299,971) are designed with annular bore crowns which employ a helical motion to obtain the corings. The coring sample is pushed up into the hollow region within the drill rods as the drill penetrates. Such prior art devices have used a core lifter ring which is fitted at the crown of the device. When the drill rods are lifted at the end of the coring procedure, the core lifter ring holds the coring sample within the drill rods so that both may be removed from the hole at once. The core sample may then be removed from the drill rods for examination and geological testing.

In known annular drilling hammers or core drills, the drive mechanism for a deep hole hammer is effected by compressed air conducted between the inner tube rods and outer tube rods and fed to a reversing valve for the hammer piston. The outgoing air from the hammer piston drive system flows out of the annular gap between the bore crown and the outer tube and finally escapes for the major part between the outer tube and the bore wall. The soil, rock or other boring material dislodged by the rotary percussion effect of the bore crown is flushed up between the outer tube and the bore hole wall by the escaping working fluid. The core, which cannot be flushed up because of its substantial weight, remains inside the bore crown or the inner tube.

The problem with such prior art devices is that the walls of the bore hole may collapse. This may block or strongly throttle the discharge of the driving and rinsing medium, which can then flow back only through the very limited space inside the drill rods. That interior space is mostly occupied by the drill core. In case of a collapse at the bore hole bottom, a complete blockage may result in which the working fluid can no longer be discharged at all. The resultant counterpressure built up in the annular drilling hammer then can put the hammer out of operation.

Other deep hole hammers (U.S. Pat. No. 2,823,013) conduct the exhaust air directly through the bore crown to permit an out-flow directly at the bore hole bottom. Rinsing necessarily takes place between the outer tube and the bore hole wall. Should the bore hole collapse, the return flow of the driving and rinsing medium is interrupted so that the hammer is put out of opertion.

An object of the present invention is to provide an annular drilling hammer which may be used for continuous drilling without the risk of clogging the discharge of the driving and rinsing medium, thus ensuring a continuous feed of the bored material.

BRIEF SUMMARY OF THE INVENTION

The present invention provides a solution to these problems and enables continuous drilling by employing a bore crown with a non-circular profile, and/or one in which the bore crown diameter is smaller than the inner diameter of the drill tubes, the rear end of the inner tube rods being provided with a device to flush out the boring material.

In the preferred embodiment, the bore crown of the device is designed to fragment the coring sample as it is drilled. The sample is then conveyed into the drill tube and transported immediately to the surface. For soil testing, the entire drill rod need not be removed from the bore hole, the rock being available above ground shortly after it has been drilled. Since the rock is conveyed internally to the drill rod, and not conveyed along the bore hole wall, it does not mingle or become contaminated with material of other rock layers. Thus the rock is suitable for soil examination and testing. Because no material is collected at the bore hole, since the core is destroyed, the bore hole bottom is continuously kept free. No drill core forms within the bore crown, so that the inner space is held free to receive additional soil material.

This invention is particularly suitable for drilling in loose rock or in layers of earth because the inner tube rods are kept free. Rinsing of the boring material will always operate through the inner tube rods, even with a collapsed bore hole. Therefore the invention is also suitable for drilling lifesaving bores in mines. The drilling can be accomplished through rubble and waste, and since the inner tube is completely free of boring material, it can be used as a conduit for supplying oxygen, food or other provisions to trapped persons.

In known drilling hammers in which the drillings are flushed up between the outer tube rods and the bore hole wall, the lifting speed is largely determined by the width of the exterior annular gap, which is dependent on the diameter of the bore crown that is used. In the present invention the lifting speed is constant because rinsing takes place exclusively through the inner tube rods.

Another advantage of this invention is that it may be used to drill through intervening cavities without impaired operation. It also may be used to drill through limestone or porphyry wherein external rinsing generally will not work.

Due to the fact that the annular bore crown destroys the bore core, the invention exhibits a high boring performance. Typically, only about $\frac{2}{3}$ of the bore hole face is drilled at one time, while the core is fragmented by impact or vibration of the bore crown.

The annular drilling hammer may also be used for heterodyne boring. To this effect, a bore hole first is drilled and subsequently objects or materials are passed through the drilling hammer to the bore hole bottom while the total drill rod system is retained in place. By this means an anchoring material or injection material, for example, concrete, may be brought to the bore hole bottom. It is also possible in this manner to place explosives at the bore hole bottom, and this action is not hindered by a core left in the internal tube.

To ensure that the rinsing medium discharged at the bore crown does not predominantly enter the inner tube and thence flow away between the outer tube and the bore hole wall, in an advantageous embodiment of the invention the bore crown has at least one aperture extending from the space between the bore crown and the outer tube to the face and/or to the inside of the bore crown. The effect of such aperture or bore at the bore crown is to conduct rinsing medium to the inside of the bore crown, from whence it flows into the inner tube. The flow causes a suction at the bore hole bottom which absorbs the loose rock into the bore crown. This suction also attracts the rinsing medium which flows out laterally from the bore crown, so that it is pulled along the bore hole bottom back to the inside of the bore crown while entraining loose rock.

To intensify the rinsing effect, it may be suitable to produce a low pressure in the inner tube which interacts with the pressure of the rinsing medium and supports it. To this end, in another embodiment of the invention, at least one Venturi opening extends above the reversing valve from the annular driving medium supply chamber into the inner tube rod system. Through the Venturi opening, a small portion of the pressure medium flows directly from the outer tube rods into the inner tube rods while generating an additional suction in the inner tube.

To ensure the destruction or fragmentation of the drill core, the opening of the bore crown may be arranged eccentrically relative to the internal tube. By the rotation of the bore crown, which normally is non-rotatably coupled to the outer tube, which itself is rotated with the entire drill string, it is ensured that any drill core which starts to form will immediately be smashed and rinsed off. The opening of the bore crown may for example be oval.

BRIEF DESCRIPTION OF THE DRAWINGS

A detailed description of the invention will be made with reference to the accompanying drawings wherein like numerals designate corresponding parts in the several figures.

DESCRIPTION OF THE PREFERRED EMBODIMENTS

The following detailed description is of the best presently contemplated modes of carrying out the invention. This description is not be be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable or unless specific exception is made.

Figure 1:
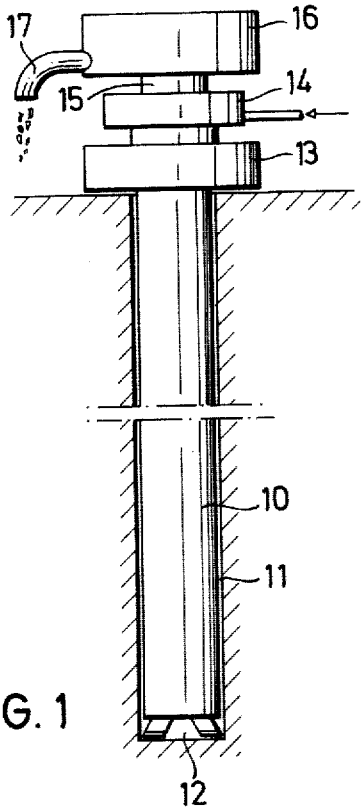
FIG. 1 is a schematic overall view of the annular drilling hammer.

The entire annular drilling hammer device is depicted schematically in FIG. 1 which shows the drill rods 10 contained within a bore hole 11. The bore crown 12 is situated at the lower end. Fixed to the upper end of the drill rods is a device 13 which rotates the drill rods 10. Above the rotating device 13 is a head 14 which supplies the driving and rinsing fluid into an annular chamber between the inner and outer tube rods. Generally the rinsing medium is compressed air, but use also may be made of a mixture of air and water, or of a completely liquid rinsing medium. The upper end 15 of the inner tube rods is connected to a rinsing head 16 which clears or removes the boring material through a connection piece 17.

Figure 2:
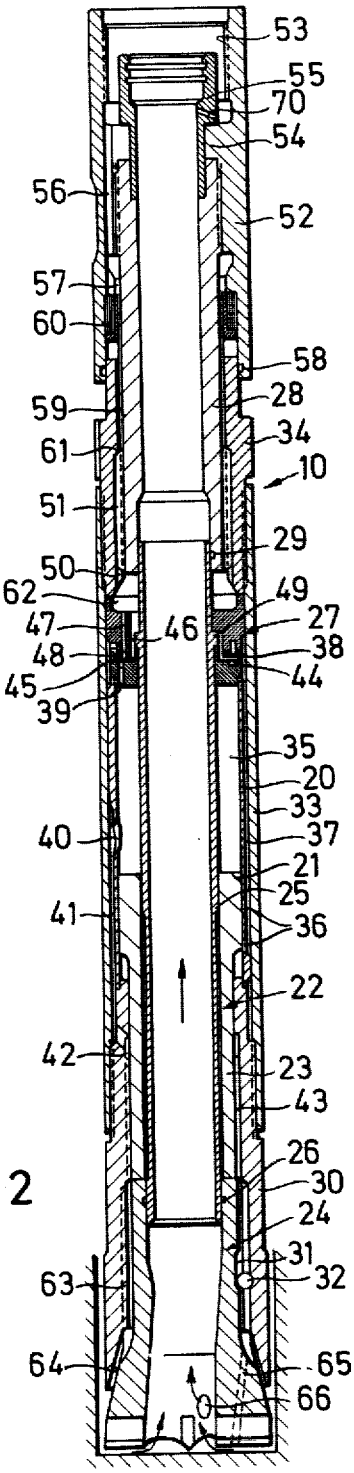
FIG. 2 is a longitudinal section through the annular drilling hammer.

FIG. 2 shows a longitudinal section of the lower end of the drill rods 10. The piston member 21 of a hammer piston 22 has a smaller outside diameter than, and moves within a tube sleeve 20. A cylindrical extension 23 of the hammer piston 22 extends forwardly (i.e., downwardly) and is adapted to strike the rear end of an annular bore crown 24. The annular hammer piston 22 is guided on an inner tube 25, the front end of which projects into the bore crown 24, where it is sealed by a ring 26. The rear (i.e., upper) end of the inner tube 25 passes through an annular reversing valve 27, and into a tube 28 by which it is guided for axial insertion and to which it is sealed by a ring 29.

The bore crown 24 is guided in an outer tube 30 and is longitudinally displaceable within limits. Axial displacement of the bore crown 24 is defined by a pin 32 which is secured transversely to the outer tube 28 and projects into a longitudinal groove 31 in the bore crown 24, and limits forward and reverse motion. The longitudinal distance which the bore crown 24 can be displaced is predetermined by the length of the longitudinal groove 31.

The rear end of the outer tube 30 is screw threaded into a jacket pipe 33 which surrounds the tube sleeve 20. The reversing valve 27 is also situated within the jacket pipe 33. The rear end of the jacket pipe 33 is threaded to a guide tube 34. A set of radial inlet apertures 36 extend through the tube sleeve 20 near the front end thereof. These inlet apertures 36 communicate to a longitudinal groove 37 at the outside of the tube sleeve 20, which groove 37 in turn communicates via an annular channel 38 to the reversing valve 27 from which another inlet opening 39 extends into the rear of the cylinder chamber 35.

Midway along the cylinder chamber 35 there is an outlet opening 40 through the tube sleeve 20 which leads to a longitudinal groove 41 that extends to the front of the tube sleeve 20. The groove 41 communicates with an annular channel 42 inside the outer tube 30. Longitudinal grooves 43 extend inside the outer tube 30 from the annular channel 42 to the bore crown 24.

The reversing valve 27 has an annular valve chamber 44 which houses an annular plate 45. From the rear end, an inlet line 46 passes by the annular plate 45 into the valve chamber 44 while another inlet line 47 abuts the annular plate 45. From the same direction as the inlet line 47, an outlet line 48 connected with the annular channel 38 abuts the annular plate 45. The lower end of the outlet line 39 connects the front end of the valve chamber 44 to the cylinder chamber 35.

The annular plate 45 may take two different positions in the valve chamber 44. In one position, the inlet line 47 and the outlet line 48 are closed, and the outlet line 39 is connected to the inlet line 46. In the alternate position of the annular plate 45, the outlet line 39 is closed, and the inlet line 47 is connected with the outlet line 48. The inner tube 25 has a flange 49 which is enclosed on each side by the two elements forming the reversing valve 27, so that the reversing valve is firmly secured to the inner tube 25. At the outer periphery the reversing valve 27 is clamped between the rear end of the tube sleeve 20 and the front end of the guide tube 34. In this manner, the outer tube 30, the jacket pipe 33, the guide tube 34, the reversing valve 27, the inner tube 25, and the tube sleeve 20 form a compact rigid assembly, the elements of which are firmly interconnected. This assembly, which forms the total lower end of the drill rods, is displaceable longitudinally relative to the other elements of the drill rods.

To effect such displacement, the inside of the guide tube 34 is provided with keyways. Key teeth 51 project from the tube 28 and extend longitudinally into the keyway. The rear end of the tube 28 is attached by a threaded screw to a socket pipe 52. The socket pipe has an internal thread 53 at its upper end into which the outer tube of another drill rod 10 is screwed. The socket pipe 52 has an internal flange 54 against which the rear end of the tube 28 abuts. A coupling member 55 is inserted through an aperture of the internal flange 54 and into the tube 28. The rear end of the coupling member 55 is adapted to receive the front end of the inner tube of another drill rod 10.

Axial bores 56 extend from the annular chamber between the thread 53 and the coupling member 55 into another annular chamber 57 inside the socket pipe 52. The longitudinal bores 56 and the annular chamber 57 serve as the feed for the rinsing and/or working fluid which flows from the socket pipe 52 into the guide tube 34 which protrudes into that socket pipe. The overlap between the socket pipe 52 and the guide tube 34 is sealed with a ring 58. The key teeth 51 of the tube 28 runs towards the rear end of the annular chamber 57 with decreasing height. They give radial supoport to an elastic buffer 60 which is fabricated out of rubber or flexible plastic. The rear end of the buffer 60 rests on an inner shoulder of the socket pipe 52, while the rear end of the buffer 60 serves an an abutment face for limiting the rearward movement of the guide tube 34.

An annular shoulder 61 of the guide tube 34 forms a stop which maintains the separation between the two groups of tubes. The lower ends of the key teeth 51 of the tube 28 abut against this shoulder 61. The second group of tubes consists of the socket pipe 52, the coupling member 55, and the tube 28.

The rinsing and working fluid is fed through the annular chamber between the internal tube rods and the external tube rods. The fluid flows into the annular chamber 57 via the longitudinal bore 56. From there it flows below the buffer 60, past the key teeth 50 and 51 into the annular chamber 62 located behind the reversing valve 27. When the annular plate 45 is in the position shown in FIG. 2, the channels 47 and 48 are blocked and the working medium flows through the lines 46 and 39 into the cylinder chamber 35. As a result, the hammer piston 22 is pressed downwardly until the outlet aperture 40 is uncovered. The working fluid then flows through the outlet aperture 40, the longitudinal groove 41, the annular channel 42, and the longitudinal grooves 43 to the bore crown 24.

When the piston 22 is driven forward, the working fluid which is behind the piston is forced through the apertures 36, the longitudinal groove 37, and the annular groove 38 into the reversing valve 27. Within the reversing vale 27, the driving medium urges the annular plate 45 into the second position, where the line 39 is closed and the lines 47 and 48 are connected. The driving fluid then flows into the forward part of the cylinder chamber 35 through the line 46 or 47, the valve chamber 44, the annular groove 38, the longitudinal groove 37 and the apertures 36, so that the hammer piston 22 is lifted. The working fluid which is displaced by the rearward movement of the hammer piston is driven out through the aperture 40 until the aperture is closed by the piston member 21. As the piston 21 continues to move, the pressure in the line 39 builds up to a degree that resets the reversing valve 27 to its first position. The working fluid again is directed into the rear portion of the cylinder chamber 35 so as to again drive the hammer piston against the bore crown and to again reverse the valve 27. In this manner the valve is periodically reversed, with the resultant periodic actuation of the hammer piston 22.

There are additional longitudinal grooves 63 within the outer tube 30, spaced around the shaft of the bore crown 24, into which the working fluid flows. The lower end 64 of the outer tube 30 is conically enlarged and in this region the driving medium flows against the bore crown 24. To ensure that as high a percentage as possible of working fluid flows back through the inside of the annular bore crown 24 rather than through the gap between the outer tube 30 and the bore hole wall, a set of bore holes 65 and 66 are provided in the bore crown 24. The bores 65 extend from the rear shoulder of the bore crown to the front end, while the bores 66 lead directly from the rear shoulder to the interior of the bore crown.

A part of the working fluid is conducted directly through the bores 65 and 66 into the interior of the bore crown 24 and thence to the inner tube 25. This direct flow creates a suction at the bore crown by which the working fluid which leaks out laterally between the outer tube 30 and the bore crown 24 is entrained and urged into the inside of the bore crown. As a result of this interaction, the boring material present on the bore hole bottom is discharged and returned through the inner tube 25 and the tube 28 to the like inner tube rods of the drill string.

Figure 3:
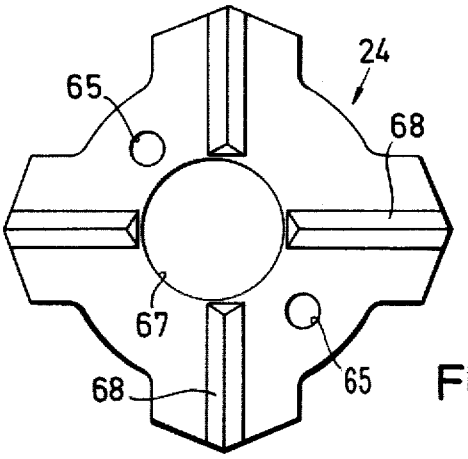
FIG. 3 is a frontal view of the bore crown.

To obtain effective discharge of the boring material from the bore hole bottom, it must be ensured that no core is left inside the annular bore crown. Advantageously, this is achieved by employing a bore crown 24 which, as shown in FIG. 3, is asymmetrical. The drill cutters 68 are constructed of hard metal and are fitted crosswise in the bore crown 24. The annular aperture 67 of the bore crown has a diameter smaller than that of inner tube 25 or of the inner tube rods. The aperture 67 is located eccentrically relative to the inner tube 25 so that the drill cutters 68 which extend to the aperture 67 are of different lengths. The asymmetric arrangement of the aperture 67 ensures that boring material will pass through the aperture without clogging and that no drilling core is left on the bore hole bottom.

Figure 4:
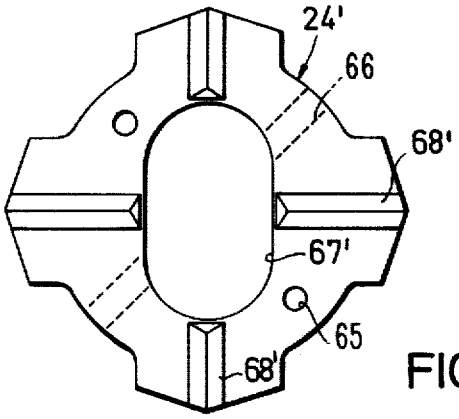
FIGS. 4 and 5 are frontal views of other bore crowns.

FIG. 4 shows an embodiment of a bore crown 24' having drill bits 68' that are arranged rectangularly with respect to one another. The aperture 67' is oblong or oval instead of circular. The bores 65 and 66 are arranged similarly to the bore crown 24 of FIGS. 2 and 3.

Figure 5:
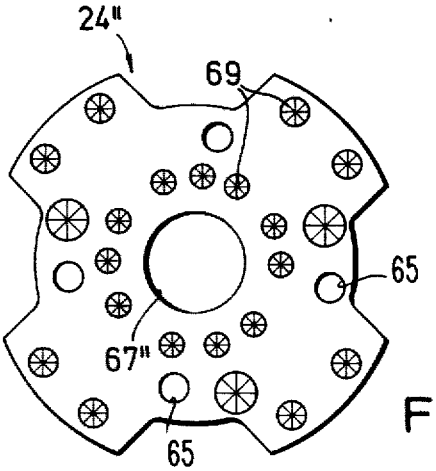

FIG. 5 shows another example of a bore crown 24'' which employs a large number of drill bit heads 69 of different sizes and arranged around an aperture 67''. The aperture 67'' is substantially smaller than the inner diameter of the inner tube 25. The bores 65 are situated in a manner similar to the bore crowns of FIGS. 2 and 3.

An inclined bore is located at the coupling member 55 (FIG. 2) and forms a Venturi aperture 70 though which working fluid flows directly from the outer tube rod 52 into the inner tube rod 28. The Venturi effect creates a suction which supports the presence acting from below on the boring material.

What is claimed is:

1. In an annular drilling hammer having an annular bore crown guided between an outer tube and an inner tube, an annular hammer piston striking periodically on the bore crown and having a piston part that is guided in a cylinder chamber between said inner and outer tubes, said cylinder chamber having control apertures, a reversing valve connected fluidically with the control apertures, a hollow inner tube rod system comunicating to the inner tube, the delivery of driving medium to the reversing valve being performed between the inner tube rod system and an outer tube rod system, the driving medium leaving the cylinder chamber being conducted between said outer tube and the bore crown and being discharged at the bore crown, the improvement comprising: at least one Venturi opening in the drill string section immediately above said reversing valve extending from a passageway for the supply of the driving medium into the inner tube rod system.

2. An annular drilling hammer according to claim 1 wherein said bore crown has at least one aperture which leads from the space between the bore crown and the outer tube to the front face of said bore crown or to the inside of said bore crown central aperture.

3. In an annular drilling hammer of a type having a down-the-hole percussive drill including a bore crown impacted by a hammer piston reciprocally operated by a driving fluid, and having a piston part that is guided in a cylinder chamber between an inner and outer tube, said cylinder chamber having control apertures and a reversing valve connected fluidically with the control apertures, the improvement comprising:

channel means extending longitudinally within the front end thereof, said front end skirting the rear shoulder of said bore crown, said bore crown having flow channels extending from the rear shoulder thereof through and to the front face or interior aperture of said bore crown, wherein the drill string section immediately above said reversing valve contains at least one Venturi opening extending from a passageway for the supply of the driving fluid in to said inner tube rod system.

4. In an annular drilling hammer having an annular bore crown guided between an outer tube and an inner tube, an annular hammer piston striking periodically on the bore crown and having a piston part that is guided in a cylinder chamber between said inner and outer tubes, said cylinder chamber having control apertures, a reversing valve connected fluidically with the control apertures, a hollow inner tube rod system communicating to the inner tube, the delivery of driving medium to the reversing valve being performed between the inner tube rod system and an outer tube rod system, the driving medium leaving the cylinder chamber being exhausted between said outer tube and the bore crown and being discharged at the bore crown, the improvement comprising:

at least one flow channel extending through said bore crown from the shoulder to the front face or to the interior aperture of said bore crown, flow of exhausted driving fluid through said at least one channel causing a suction effect which aids the return of substantially all exhausted driving fluid and bored material through said interior aperture and through the inner tube rod system of said drilling hammer, and at least one Venturi opening in the drill string section immediately above said reversing valve extending from a passageway for the supply of the driving fluid into the inner tube rod system, said Venturi being above said reversing valve so as to produce a Venturi effect utilizing the full continuous force of the driving fluid to aid in the removal of bored material from the bore crown area.

5. An annular drilling hammer having an annular bore crown guided between an outer tube and an inner tube, an annular hammer piston striking periodically on the bore crown and having a piston part that is guided in a cylinder chamber between said inner and outer tubes, said cylinder chamber having control apertures, a reversing valve connected fluidically with the control apertures, a hollow inner tube rod system communicating to the inner tube, the delivery of driving medium to the reversing valve being performed between the inner tube rod system and an outer tube rod system, the driving medium being exhausted from the front end of the drill string inner tube facing the bore crown shoulder, comprising:

at least one flow channel extending through said bore crown from the shoulder to the front face or to the interior aperture of said bore crown, flow of exhausted driving fluid and bored material through said interior aperture and through the inner tube rod system of said drilling hammer; and means for transporting said exhausted driving fluid and bored material back through the interior of said drill string inner tube, wherein said means for transporting said exhausted driving fluid and bored material is at least one Venturi opening above said reversing valve extending from a passageway for the supply of the driving medium into the inner tube rod system.

* * * * *